US008342810B2

(12) United States Patent
Koyama

(10) Patent No.: US 8,342,810 B2
(45) Date of Patent: Jan. 1, 2013

(54) START-UP CONTROL DEVICE AND METHOD FOR ELECTRIC SCROLL COMPRESSOR

(75) Inventor: Shigeyuki Koyama, Isesaki (JP)

(73) Assignee: Sanden Corporation, Gunma (JP)

( * ) Notice: Subject to any disclaimer, the term of this patent is extended or adjusted under 35 U.S.C. 154(b) by 381 days.

(21) Appl. No.: 12/602,449

(22) PCT Filed: May 21, 2008

(86) PCT No.: PCT/JP2008/059361
§ 371 (c)(1),
(2), (4) Date: Nov. 30, 2009

(87) PCT Pub. No.: WO2008/149673
PCT Pub. Date: Dec. 11, 2008

(65) Prior Publication Data

US 2010/0178175 A1 Jul. 15, 2010

(30) Foreign Application Priority Data

Jun. 1, 2007 (JP) ..... 2007-146894

(51) Int. Cl.
*F04B 49/06* (2006.01)
*F25B 49/00* (2006.01)
*F25B 31/00* (2006.01)

(52) U.S. Cl. ..... 417/32; 62/228.1; 417/44.2

(58) Field of Classification Search ..... 417/32, 417/38, 44.2, 44.1; 62/228.3, 228.1
See application file for complete search history.

(56) References Cited

U.S. PATENT DOCUMENTS 4,263,540 A * 4/1981 Brandt et al. ..... 318/775
(Continued)

FOREIGN PATENT DOCUMENTS

JP 59-160081 9/1984
(Continued)

OTHER PUBLICATIONS

English Abstract for JP08193756A dated Jul. 30, 1996.*
(Continued)

*Primary Examiner* — Charles Freay
*Assistant Examiner* — Nathan Zollinger
(74) *Attorney, Agent, or Firm* — Cozen O'Connor

(57) ABSTRACT

A device executing a start-up control method for an electric scroll compressor has a thermistor (18) and a pressure sensor (20) which, prior to the start-up of the scroll compression unit, detect temperature and pressure of a suction refrigerant introduced into the compression unit (2), and a controller (10) for controlling driving of a motor (4) of the compression unit (2) at the start-up of the compressor. The controller (10) determines at the start-up of the compressor whether or not a liquid refrigerant exists in the compression unit (2) on the basis of the detected temperature and pressure; selects either a normal start-up mode or a liquid-discharge mode in which the rotational speed of the motor (4) is regulated to be lower than in the normal start-up mode, according to the determination result; and controls the start-up of the compression unit (2) through the motor (4) according to the selected mode.

10 Claims, 3 Drawing Sheets

U.S. PATENT DOCUMENTS

| | | | | |
|---|---|---|---|---|
| 4,622,827 | A * | 11/1986 | Jabami et al. | 62/158 |
| 4,765,150 | A * | 8/1988 | Persem | 62/215 |
| 5,518,373 | A * | 5/1996 | Takagi et al. | 417/45 |
| 5,779,450 | A * | 7/1998 | Fujiwara et al. | 417/45 |
| 5,950,439 | A * | 9/1999 | Peterson et al. | 62/80 |
| 6,406,265 | B1 * | 6/2002 | Hahn et al. | 417/19 |
| 6,619,062 | B1 * | 9/2003 | Shibamoto et al. | 62/228.3 |
| 6,886,354 | B2 * | 5/2005 | Dudley | 62/193 |
| 7,191,608 | B2 * | 3/2007 | Yamasaki et al. | 62/229 |
| 7,412,841 | B2 * | 8/2008 | Ueda et al. | 62/228.3 |
| 7,412,842 | B2 * | 8/2008 | Pham | 62/228.5 |
| 7,775,057 | B2 * | 8/2010 | VanderZee | 62/222 |
| 7,946,123 | B2 * | 5/2011 | Tolbert et al. | 62/228.4 |
| 2004/0194485 | A1 | 10/2004 | Dudley | |
| 2005/0235664 | A1 * | 10/2005 | Pham | 62/126 |
| 2009/0324427 | A1 * | 12/2009 | Tolbert et al. | 417/13 |

FOREIGN PATENT DOCUMENTS

| | | | |
|---|---|---|---|
| JP | 62-147264 | | 7/1987 |
| JP | 5-99165 | | 4/1993 |
| JP | 08192756 | A * | 7/1996 |
| JP | 08-210277 | | 8/1996 |
| JP | 08210277 | A * | 8/1996 |

OTHER PUBLICATIONS

English Abstract for JP08210277A dated Aug. 20, 1996.*
Office Action issued on Apr. 19, 2012 in the corresponding Chinese Patent Application No. 200880018491.5.

* cited by examiner

START-UP CONTROL DEVICE AND METHOD FOR ELECTRIC SCROLL COMPRESSOR

RELATED APPLICATIONS

This is a U.S. National Phase Application under 35 USC §371 of International Application PCT/JP2008/059361 filed on May 21, 2008.

This application claims the priority of Japanese Patent Application No. 2007-146894 filed Jun. 1, 2007, the entire content of which is hereby incorporated by reference.

1. Technical Field

The present invention relates to an electric scroll compressor installed in a vehicle refrigeration system, and more specifically, to a device and method for controlling the start-up of the compressor.

2. Background Art

An electric scroll compressor includes a scroll compression unit, a motor for driving the compression unit, and an inverter for controlling the rotational speed of the motor. When such a compressor is installed in a vehicle refrigeration system, the compressor is mounted on the vehicle. Therefore, the ambient temperature of the compressor is greatly influenced by the use environment of the vehicle. For this reason, in a situation where the temperature of the use environment of the vehicle or the ambient temperature of the compressor is low, a refrigerant within the compressor is sometimes partially liquefied by the time of starting up the compressor. In this case, when the compressor is started up in a normal operation mode, the liquid refrigerant causes a water hammer phenomenon within the compressor. The water hammer phenomenon rapidly increases a drive torque required for the compressor, so that the inverter ends up supplying excessive current to the motor.

As a measure for preventing such a situation, a control device for an inverter has been known. This control device monitors the current supplied to the motor at the start-up of the compressor, and simultaneously controls the rotational speed (the output frequency of the inverter) of the motor, namely, the rotational speed of the compressor. The control device thus prevents the generation of the water hammer phenomenon, that is, the supply of excessive current to the motor (for example, Patent Document 1). When the rotational speed of the compressor is controlled during the start-up control mode, the liquid refrigerant within the compressor is discharged through gaps between scrolls in the compression unit into an oil storage chamber or a suction chamber of the compression unit.

[Patent Document 1] Unexamined Japanese Patent Publication No. JP 08-201277

DISCLOSURE OF THE INVENTION

Problem to be Solved by the Invention

The control device disclosed in Patent Document 1 controls the rotational speed of the motor in the above-mentioned start-up control mode every time the compressor is started up. It therefore takes a long time before the operation of the compressor is shifted from the start-up control mode to the normal operation mode, regardless of the use environment.

At the start-up of the compressor, whether a liquid refrigerant exists in the compressor is determined on the basis of whether or not excessive current is generated after the start-up control mode is started. The electric motor is accordingly required to have high mechanical strength in expectation of the generation of the excessive current, or an increase in drive torque. It is then difficult to reduce the size and weight of the motor.

An object of the invention is to provide a start-up control device and method for an electric scroll compressor that is capable of implementing start-up control on a compressor effectively and in short time, and enables a reduction in size and weight of a motor.

Means for Solving Problem

In order to achieve the object, the invention provides a start-up control device for an electric scroll compressor including a motor and a scroll compression unit driven with the motor and used to compress a refrigerant. The start-up control device of the invention comprises a detector for detecting temperature and pressure of a refrigerant existing in the compression unit prior to start-up of the compression unit, and outputting a detection result, and a controller for controlling driving of the motor at a start-up of the compressor, the controller including a determination section for determining whether or not a liquid refrigerant exists in the compression unit on the basis of the detection result of the detector, and an executing section for executing the driving of the motor according to a start-up control process selected on the basis of the determination result of the determination section. The start-up control process has a normal start-up mode for being selected when the liquid refrigerant does not exist and a liquid-discharge mode for being selected when there is the liquid refrigerant and regulating a rotational speed of the motor to be lower than in the normal start-up mode.

with the start-up control device, it is determined, prior to a start-up of the compressor, whether or not the liquid refrigerant exists in the compression unit. Based upon the determination result, the motor is driven in the normal start-up mode or liquid-discharge mode, thereby starting up the compressor, or the compression unit.

When the motor is driven in the liquid-discharge mode, the rotational speed of the motor, namely, start-up speed of the compression unit is lower than in the normal start-up mode. For this reason, a gap between a fixed scroll and a movable scroll in the compression unit is increased. A portion of the liquid refrigerant within the compression unit leaks out of the gap toward an outlet of the compression unit, and is discharged from the outlet. At the start-up of the compressor, therefore, the water hammer phenomenon does not take place.

Preferably, the liquid-discharge mode takes a longer execution time than the normal start-up mode, so that the discharge of the liquid refrigerant from the compression unit is reliably carried out. More specifically, the rotational speed of the motor in the liquid-discharge mode is regulated to secure such a gap between the fixed and movable scrolls as to allow the liquid refrigerant to leak out.

The compressor may include a common housing in which both the motor and the compression unit are accommodated, and into which the refrigerant is introduced. In this case, the detector may include a temperature sensor located in the housing, for detecting a temperature of the refrigerant introduced into the housing as refrigerant temperature in the compression unit, and a pressure sensor for detecting a pressure of the refrigerant introduced into the housing as refrigerant pressure in the compression unit.

Further preferably, the controller includes a timer for measuring a rest time from a point at which the operation of the compression unit is halted to a point at which the compression unit is started up. In this case, when the determination section determinates that there is a gas-liquid mixing state in which presence of the liquid refrigerant is unclear, the determination section can determine whether or not the liquid refrigerant exists on the basis of the temperature of the refrigerant in the compression unit and the rest time of the compression unit.

The invention also provides a start-up control method for an electric scroll compressor. The start-up control method will be clearly described later.

Advantages of the Invention

The start-up control device and method of the invention starts up the compression unit in the liquid-discharge mode only when the liquid refrigerant exists in the compression unit, and never prolongs the start-up of the compressor. Since the water hammer phenomenon is reliably prevented from taking place at the start-up of the compressor, the motor can be reduced in size and weight.

BEST MODE FOR CARRYING OUT THE INVENTION

Figure 1:
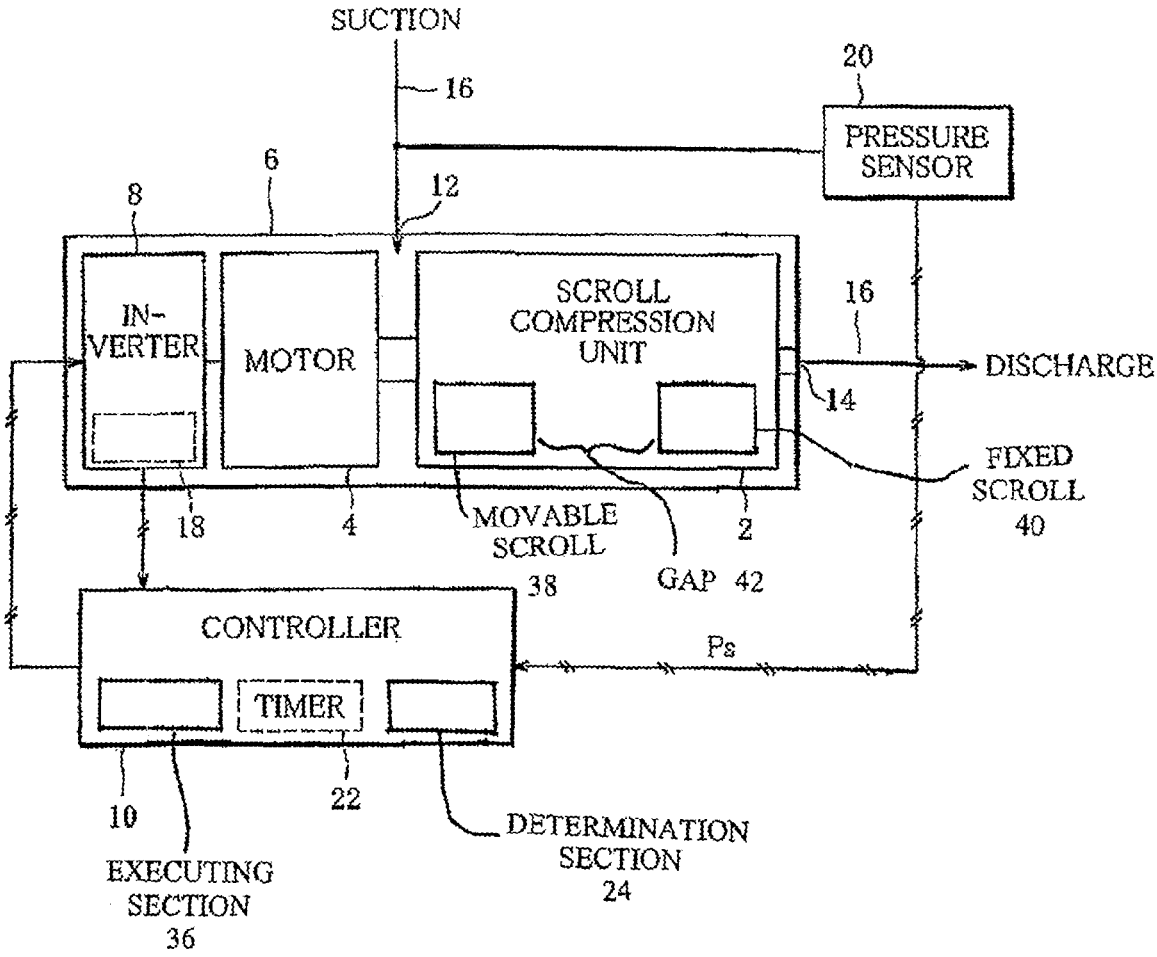
FIG. 1 is a schematic view showing an electric scroll compressor of one embodiment.

FIG. 1 schematically shows an electric scroll compressor (hereinafter, referred to as a compressor) together with a start-up control device of one embodiment.

Prior to the description of the start-up control device, the compressor will be shortly described below.

The compressor has a scroll compression unit 2. The compression unit 2 is driven with a motor 4. The compression unit 2 and the motor 4 are accommodated in a housing 6 of the compressor. An inverter 8 is also accommodated in the housing 6. The inverter 8 is used to control the rotation of the motor 4.

The inverter 8 is electrically connected to a controller 10. When receiving a command from the controller 10, the inverter 8 controls the driving and operation of the motor 4. More specifically, the inverter 8 controls the rotation of a movable scroll in the compression unit 2.

The housing 6 has an inlet port 12 and an outlet port 14 for a refrigerant, respectively. The inlet port 12 and the outlet port 14 are connected to a refrigerant circulation path 16 of a refrigerant system. The refrigerant circulates in the refrigerant circulation path 16, passing through the compression unit 2, and moreover, a portion of the refrigerant is even used to refrigerate the motor 4 and the inverter 8.

More specifically, the refrigerant within the refrigerant circulation path 16 flows through the inlet port 12 into the housing 6 as a suction refrigerant. The suction refrigerant has low temperature. A portion of the suction refrigerant passes through the inverter 8 and the motor 4, and thus refrigerates the inverter 8 and the motor 4. At the same time, the suction refrigerant is sucked into the compression unit 2 through an inlet of the compression unit 2. The sucked refrigerant is compressed within the compression unit 2, and then discharged from the outlet port 14 into the refrigerant circulation path 16.

In addition to the controller 10, the start-up control device of the compressor further includes sensors for detecting a state of the refrigerant in the compression unit 2, that is, the temperature and pressure of the refrigerant. These sensors are electrically connected to the controller 10. Specifically, the inverter 8 has a thermistor 18 serving as a temperature sensor. The thermistor 18 detects the temperature of the suction refrigerant flown into the housing 6. The detected temperature is supplied from the thermistor 18 to the controller 10 as refrigerant temperature in the compression unit 2 prior to the start-up of the compression unit 2.

A pressure sensor 20 is located in the refrigerant circulation path 16. The pressure sensor 20 detects a pressure of the suction refrigerant flowing into the housing 6 through the inlet port 12, that is, the refrigerant within an evaporator of the refrigeration system. The detected pressure is supplied from the pressure sensor 20 to the controller 10 as refrigerant pressure within the compression unit 2 prior to the start-up of the compression unit 2.

The controller 10 includes a timer 22 therein. The timer 22 measures an elapsed time from the stop of the compression unit 2 every time the operation of the motor 4 or the compression unit 2 is halted, as a rest time St of the compression unit 2.

Figure 2:
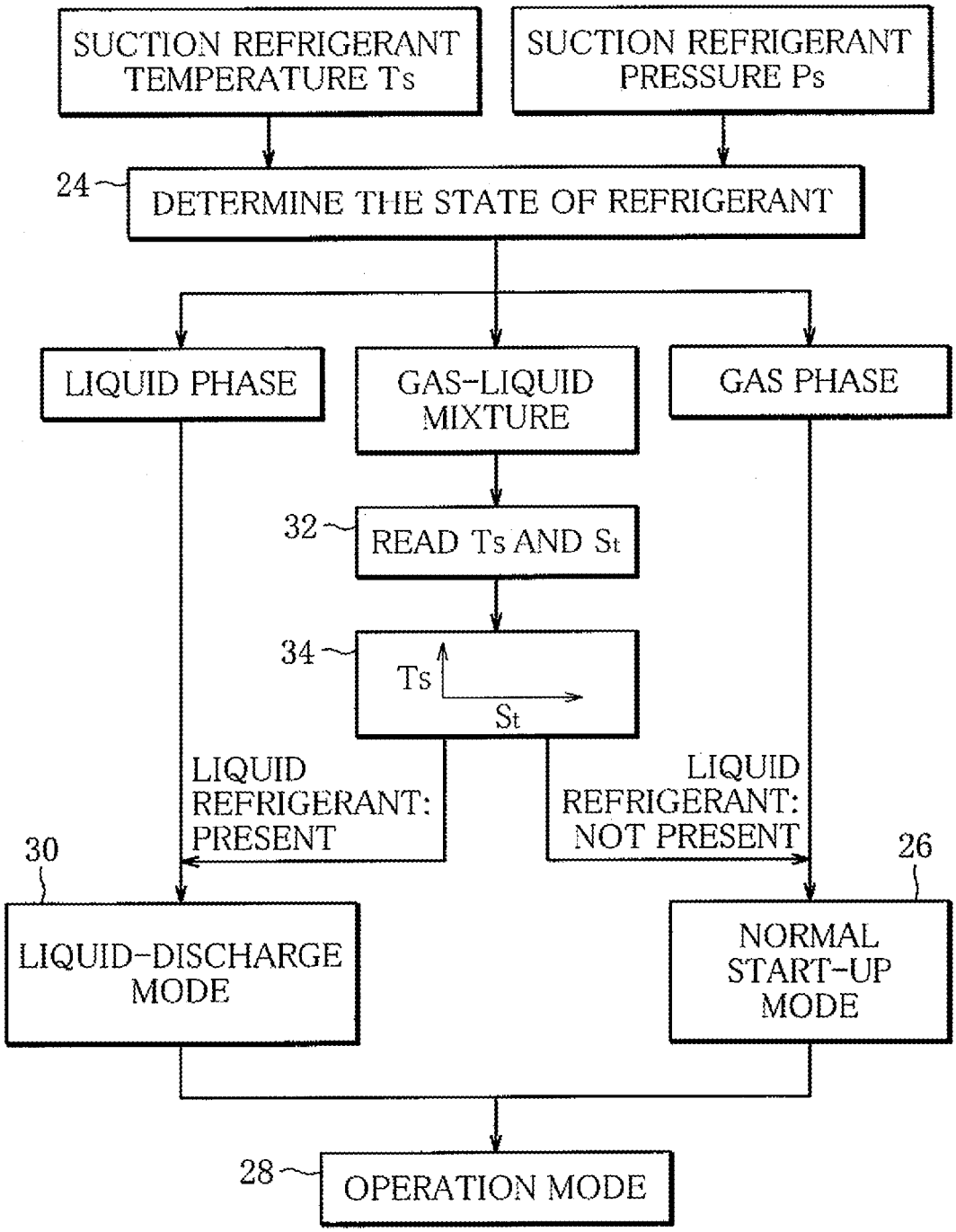
FIG. 2 is a block diagram for explaining start-up control implemented by a controller shown in FIG. 1.

The controller 10 controls the start-up of the motor 4 or the compression unit 2, according to the temperature and pressure detected by the thermistor 18 and the pressure sensor 20. FIG. 2 shows the details of the control in a block diagram.

Figure 3:
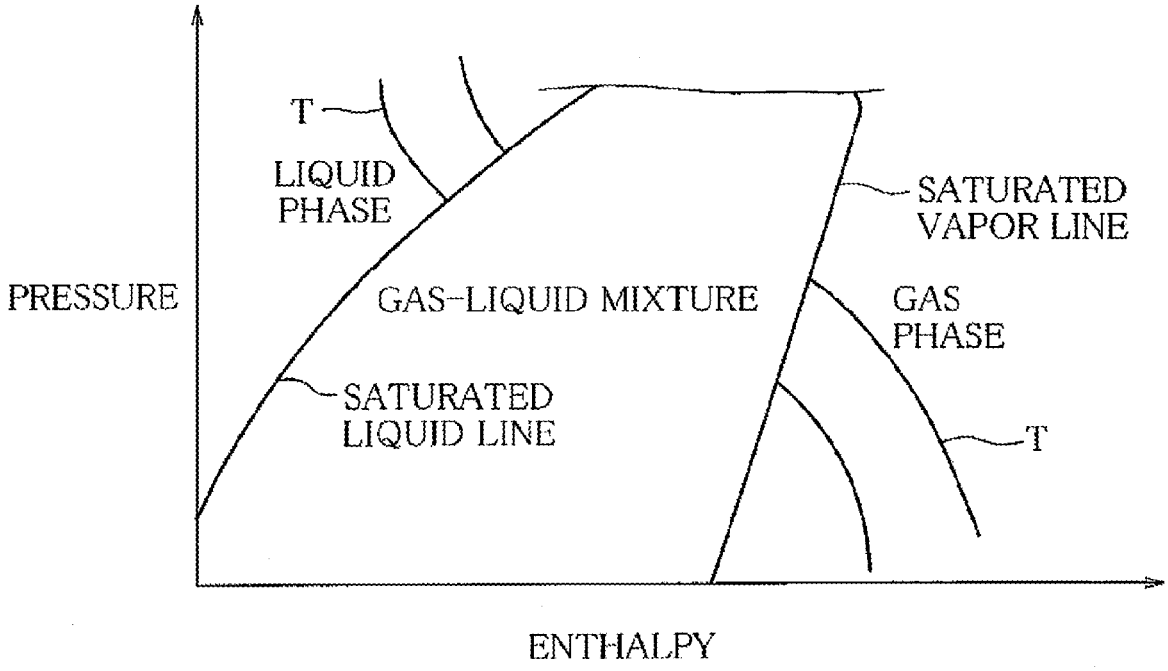
FIG. 3 is a Mollier diagram of a refrigerant.

The controller 10 includes a determination section 24 for determining the state of the refrigerant within the compression unit 2. Temperature Ts and pressure Ps of the suction refrigerant are supplied to the determination section 24. Based upon the temperature Ts and the pressure Ps, the determination section 24 determinates the state of the refrigerant within the compression unit 2. More specifically, the determination section 24 includes map data obtained by converting a Mollier diagram of the refrigerant, which is shown in FIG. 3, into a map. Based upon the map data, the temperature Ts and the pressure Ps, the determination section 24 determines that the refrigerant within the compression unit 2 is which state among a gas-phase state, a liquid-phase state and a gas-liquid mixing state.

Conditions for liquefaction of the refrigerant within the compression unit 2 are that the temperature of the compression unit 2 (temperature of an engine room) is lower than the temperature of the refrigerant within the evaporator (temperature of a vehicle interior) and that predetermined time has elapsed after the operation of the compressor was stopped. Therefore, it is effective to use the temperature Ts and pressure Ps of the suction refrigerant, instead of directly detecting the temperature and pressure of the refrigerant within the compression unit 2 for determining the state of the refrigerant within the compression unit 2.

When the determination section 24 determines that the refrigerant is in the gas-phase state, the controller 10 controls through an executing section 36 a rotational speed of the motor 4 through the inverter 8 in a normal start-up mode 26, and simultaneously drives the compression unit 2. After the start-up mode 26 is completed, the rotation of the motor 4 is controlled in a selected operation mode 28.

In this embodiment, the normal start-up mode 26 means a mode in which the rotational speed of the motor 4 is increased from a rest state at an increment rate according to a rotational speed of the compression unit 2, which is required for the selected operation mode 28.

When the determination section 24 determines that the refrigerant is in the liquid-phase state, the controller 10 controls through the executing section 36 the rotational speed of the motor 4 through the inverter 8 in a liquid-discharge mode 30, and drives the compression unit 2. The rotational speed of the motor 4 in the liquid-discharge mode 30 is so regulated as to be lower than the rotational velocity of the motor 4 in the normal start-up mode 26. Execution time of the liquid-discharge mode 30 is longer than that of the normal start-up mode 26. More specifically, the execution time of the liquid-discharge mode 30 is divided into a first state in which the rotational speed of the motor 4 is regulated and a second state in which the rotational speed of the motor 4 is increased at the increment rate applied in the normal start-up mode 26.

It should be noted that the scroll compression unit 2 has a property mentioned below.

Property: Gaps 42 between a movable scroll 38 and a fixed scroll 40 in the compression unit 2 are reduced as the rotational speed of the compression unit 2 or the movable scroll increases.

This property shows that the gaps are increased as the rotational speed of the movable scroll is reduced. Accordingly, during the execution of the liquid-discharge mode 30, the rotational velocity of the movable scroll (compression unit 2) in the first stage is regulated so that the gaps 42 between the movable and fixed scrolls 38, 40 are large enough to allow the liquid refrigerant to pass through.

As a result, during the execution of the liquid-discharge mode 30, a portion of the liquid refrigerant within the compression unit 2 is discharged into a discharge chamber of the compressor through the gaps and an outlet of the compression unit 2. At the start-up of the compression unit 2, therefore, a water hammer phenomenon does not take place in the compression unit 2. Consequentially, excessive current is not supplied to the motor 4 attributable to a water hammer phenomenon. Since the water hammer phenomenon is prevented in this manner, there is no possibility that the motor 4 suffers great load, and the motor 4 can be reduced in size and weight.

After the execution of the liquid-discharge mode 30 is completed, the controller 10 controls the rotational speed of the motor 4 in the selected operation mode.

When the state of the refrigerant is neither the gas-phase state nor the liquid-phase state, the determination section 24 determines that the refrigerant is in the gas-liquid mixing state. In other words, when the refrigerant is in the gas-liquid mixing state, it is difficult to make a determination as to whether or not the liquid refrigerant exists in the compression unit 2 on the basis of the temperature and pressure of the refrigerant.

In the foregoing case, the controller 10 reads the temperature Ts of the suction refrigerant and the rest time St in a reading section 32. In a subsequent determination section 34, the controller 10 determines whether or not the liquid refrigerant exists in the compression unit 2 on the basis of the temperature Ts and the rest time St.

Specifically, a condition in which the liquid refrigerant occurs in the compression unit 2 is beforehand found out by an experiment. Results of the experiment are shown in the form of a map using the temperature Ts and the rest time St as parameters, and are stored in the determination section 34 as map data.

Even if the refrigerant is in the gas-liquid mixing state, the controller 10 is capable of reliably determining whether or not the liquid refrigerant exists in the compression unit 2 in the determination section 34. When the determination section 34 determines that there is no liquid refrigerant, the controller 10 executes the normal start-up mode 26, whereby the start-up of the compression unit 2 is completed in short time. On the contrary, when the determination section 34 determines that there is the liquid refrigerant, the controller 10 executes the liquid-discharge mode 30. This makes it possible to surely prevent the supply of excessive current to the motor 4 which is caused by a water hammer phenomenon.

The invention claimed is:

1. A start-up control device for an electric scroll compressor including a motor and a scroll compression unit driven with the motor and used to compress a refrigerant, comprising:

a detector for detecting temperature and pressure of the refrigerant existing in the compression unit prior to start-up of the compressor, and outputting a detection result; and a controller for controlling driving of the motor at start-up of the compressor, the controller including a determination section for determining whether or not liquid refrigerant exists in the compression unit on the basis of the detection result of the detector, and a executing section for executing the driving of the motor according to a start-up control process selected on the basis of the determination result of the determination section, wherein:

the start-up control process includes:

a normal start-up mode for being selected when liquid refrigerant does not exist in the compression unit; and a liquid-discharge mode for being selected when there is liquid refrigerant in the compression unit and regulating a rotational speed of the motor to be non-zero and lower than in the normal start-up mode.

2. The start-up control device for an electric scroll compressor according to claim 1, wherein the liquid-discharge mode takes a longer execution time than the normal start-up mode.

3. The start-up control device for an electric scroll compressor according to claim 1, wherein:

the compression unit includes a fixed scroll and a movable scroll rotated with the motor, and the rotational speed of the motor in the liquid-discharge mode is regulated to secure such a gap between the fixed and movable scrolls as to allow the liquid refrigerant to leak out.

4. The start-up control device for an electric scroll compressor according to claim 1, wherein:

the compressor includes a common housing in which both the motor and the compression unit are accommodated, and into which the refrigerant is introduced; and the detector includes a temperature sensor located in the housing, for detecting a temperature of the refrigerant introduced into the housing as refrigerant temperature in the compression unit, and a pressure sensor for detecting a pressure of the refrigerant introduced into the housing as refrigerant pressure in the compression unit.

5. A start-up control device for an electric scroll compressor including a motor and a scroll compression unit driven with the motor and used to compress a refrigerant, comprising:

a detector for detecting temperature and pressure of the refrigerant existing in the compression unit prior to start-up of the compressor, and outputting a detection result; and a controller for controlling driving of the motor at start-up of the compressor, the controller including a determination section for determining whether or not liquid refrigerant exists in the compression unit on the basis of the detection result of the detector, and a executing section for executing the driving of the motor according to a start-up control process selected on the basis of the determination result of the determination section, wherein:

the start-up control process includes:

a normal start-up mode for being selected when liquid refrigerant does not exist in the compression unit; and a liquid-discharge mode for being selected when there is liquid refrigerant in the compression unit and regulating a rotational speed of the motor to be lower than in the normal start-up mode, wherein:

the controller further includes a timer for measuring a rest time from a point at which operation of the compression unit is stopped to a point at which the compression unit is started up;

the determination result of the determination section includes a gas-phase state in which there is no liquid refrigerant in the compression unit, a liquid-phase state in which there is liquid refrigerant in the compression unit, and a gas-liquid mixing state in which presence of liquid refrigerant in the compression unit is unclear; and when the determination result is the gas-liquid mixing state, the determination section determines whether or not liquid refrigerant exists in the compression unit on the basis of refrigerant temperature in the compression unit and the rest time.

6. A start-up control method for an electric scroll compressor including a motor and a scroll compression unit driven with the motor and used to compress a refrigerant, comprising steps of:

detecting temperature and pressure of the refrigerant existing in the compression unit prior to a start-up of the compressor, and outputting a detection result of said detecting step;

controlling driving of the motor at the start-up of a compressor, said controlling step including a determination process of determining on the basis of the detection result of said detecting step whether or not liquid refrigerant exists in the compression unit, and an execution process of executing the driving of the motor according to a start-up control process selected on the basis of the determination of the determination process, wherein:

the start-up control process includes:

a normal start-up mode for being selected when liquid refrigerant does not exist in the compression unit; and a liquid-discharge mode for being selected when there is liquid refrigerant in the compression unit and regulating a rotational speed of the motor to be non-zero and lower than in the normal start-up mode.

7. The start-up control method for an electric scroll compressor according to claim 6, wherein the liquid-discharge mode takes a longer execution time than the normal start-up mode.

8. The start-up control method for an electric scroll compressor according to claim 6, wherein the liquid-discharge mode regulates the rotational speed of the motor to secure such a gap between fixed and movable scrolls of the compression unit as to allow the liquid refrigerant to leak out.

9. The start-up control method for an electric scroll compressor according to claim 6, wherein:

the compressor includes a common housing in which both the motor and the compression unit are accommodated, and into which the refrigerant is introduced; and said detecting step detects a temperature of the refrigerant introduced into the housing as refrigerant temperature in the compression unit, and a pressure of the refrigerant introduced into the housing as refrigerant pressure in the compression unit.

10. A start-up control method for an electric scroll compressor including a motor and a scroll compression unit driven with the motor and used to compress a refrigerant, comprising steps of:

detecting temperature and pressure of the refrigerant existing in the compression unit prior to a start-up of the compressor, and outputting a detection result of said detecting step;

controlling driving of the motor at the start-up of the compressor, said controlling step including a determination process of determining on the basis of the detection result of said detecting step whether or not liquid refrigerant exists in the compression unit, and an execution process of executing the driving of the motor according to a start-up control process selected on the basis of the determination of the determination process, wherein:

the start-up control process includes:

a normal start-up mode for being selected when liquid refrigerant does not exist in the compression unit; and a liquid-discharge mode for being selected when there is liquid refrigerant in the compression unit and regulating a rotational speed of the motor to be lower than in the normal start-up mode, wherein:

the determination process measures a rest time from a point at which operation of the compression unit is halted to a point at which the compression unit is started up;

the determination result of the determination process includes a gas-phase state in which there is no liquid refrigerant in the compression unit, a liquid-phase state in which there is liquid refrigerant in the compression unit, and a gas-liquid mixing state in which presence of liquid refrigerant in the compression unit is unclear; and when the determination result is the gas-liquid mixing, state, the determination process determines whether or not the liquid refrigerant exists in the compression unit on the basis of refrigerant temperature in the compression unit and the rest time.

* * * * *